US008753504B2

(12) United States Patent
Whyatt et al.

(10) Patent No.: US 8,753,504 B2
(45) Date of Patent: Jun. 17, 2014

(54) SYSTEMS AND PROCESSES FOR REMOVING ELEMENTAL SULFUR COMPOUNDS FROM DESULFURIZED FUELS

(75) Inventors: Gregory A. Whyatt, West Richland, WA (US); Liyu Li, Richland, WA (US)

(73) Assignee: Battelle Memorial Institute, Richland, WA (US)

( * ) Notice: Subject to any disclaimer, the term of this patent is extended or adjusted under 35 U.S.C. 154(b) by 413 days.

(21) Appl. No.: 13/096,871

(22) Filed: Apr. 28, 2011

(65) Prior Publication Data

US 2012/0273393 A1 Nov. 1, 2012

(51) Int. Cl.

| | |
|---|---|
| ***C10G 65/02*** | (2006.01) |
| ***C10G 65/04*** | (2006.01) |
| *C10G 45/08* | (2006.01) |
| *C10G 45/02* | (2006.01) |

(52) U.S. Cl.

CPC ..... *C10G 65/04* (2013.01); *C10G 45/08* (2013.01); *C10G 45/02* (2013.01)

USPC ..... 208/210; 208/100; 208/208 R; 208/209; 208/213

(58) Field of Classification Search

USPC ..... 208/210

See application file for complete search history.

(56) References Cited

U.S. PATENT DOCUMENTS

| | | | | |
|---|---|---|---|---|
| 3,806,444 | A * | 4/1974 | Crouch et al. | 208/68 |
| 2003/0178343 | A1 | 9/2003 | Chen et al. | |
| 2003/0217951 | A1 | 11/2003 | Marchal-George et al. | |
| 2007/0114156 | A1 | 5/2007 | Greeley et al. | |
| 2007/0267326 | A1 * | 11/2007 | De Almeida et al. | 208/210 |
| 2009/0035622 | A1 * | 2/2009 | King et al. | 429/17 |
| 2009/0188837 | A1 * | 7/2009 | Podrebarac | 208/210 |

OTHER PUBLICATIONS

International Search Report/Written Opinion for International Application No. PCT/US2012/022420, International Filing Date Jan. 24, 2012, Date of Mailing Apr. 24, 2012.

Achmann, S., et al., Sulfur Removal From Low-Sulfur Gasoline and Diesel Fuel by Metal-Organic Frameworks, Chem. Eng. Technol., 2010, 33, No. 2, 275-280.

* cited by examiner

*Primary Examiner* — Prem C Singh
*Assistant Examiner* — Brandi M Doyle
(74) *Attorney, Agent, or Firm* — James D. Matheson

(57) ABSTRACT

A system and process are disclosed for removing elemental sulfur compounds from hydro-desulfurization (HDS) treated hydrocarbon products including liquid hydrocarbon fuels. Low (sub-ppm) concentrations of sulfur remain in the hydrocarbons, providing, e.g., fuel products suitable for use in various modalities including, e.g., jet fuels and fuel cell Auxiliary Power Units (APUs).

22 Claims, 6 Drawing Sheets

SYSTEMS AND PROCESSES FOR REMOVING ELEMENTAL SULFUR COMPOUNDS FROM DESULFURIZED FUELS

STATEMENT REGARDING FEDERALLY-SPONSORED RESEARCH AND DEVELOPMENT

This invention was made with United States Government support under Contract No.: W56HZV-06-C-0343 from the U.S. Army Tank Automotive Research Development and Engineering Center (TARDEC) and Contract No.: FA8222-05-D-0003 from the U.S. Air Force Advanced Power Technology Office awarded to Battelle Memorial Institute. The Government has certain rights in the invention.

FIELD OF THE INVENTION

The present invention relates generally to methods for removing sulfur from liquid fuels. More particularly, the invention includes a system and a process for removing elemental sulfur compounds from hydrocarbons including liquid fuels that have previously undergone reformate hydrodesulfurization (HDS).

BACKGROUND OF THE INVENTION

The removal of sulfur from hydrocarbon fuels reduces the sulfur dioxide emissions that result from combustion of those fuels and prevents the poisoning of expensive catalysts that utilize these fuels for other purposes. In addition, the proper operation of various technologies such as fuel cells requires the use of hydrocarbon fuels with very low sulfur concentrations. Therefore a variety of methodolgies have been employed to economically and efficiently reduce sulfur concentrations in hydrocarbon fuels. Industrial hydrodesulfurization processes typically focus upon the conversion of organic sulfur to $H_2S$ and capture and removal of hydrogen sulfide ($H_2S$) gas. However, these processes are still less than fully effective in removing all of the sulfur from these fuels. HDS treatment of high sulfur fuel can result in elemental sulfur compounds remaining in the fuel after one stage of treatment and in the case of very high sulfur contents in the fuel, contamination levels of up to 100 ppmw of elemental sulfur can still exist. This level of sulfur contamination makes the use of such fuels unsuitable in a steam reformer. While other approaches including a second HDS treatment or high levels of hydrogen relative to fuel may remove/reduce this sulfur contamination, the high pressure and temperature of HDS process makes this an expensive option. What is needed is a method or system for elemental sulfur removal that provides efficient enhanced sulfur removal capability and enables JP-8 and other kerosene based fuels to be sufficiently desulfurized so as to be used in steam reformers and other very low sulfur applications.

SUMMARY OF THE INVENTION

The present invention is a method for removing sulfur from hydrocarbon fuels by a stepwise process wherein hydrosulfurization reaction products are condensed at relatively low temperatures (between 50 and 200 degrees C.) to separate a liquid product from a $H_2S$ containing gas in the vapor phase. This liquid product contains elemental sulfur which is reacted with a hydrogen containing gas in the presence of a catalyst to react the elemental sulfur with hydrogen to form $H_2S$ which is then separated as a gas from the hydrocarbon liquid fuel. The remaining hydrocarbon liquid fuel is then sufficiently desulfurized so as to be suitably utilized in a steam reforming reaction. This low temperature desulfurization process provides an energy efficient way to remove sulfur to very low concentrations. This method is directly contrary to many of the methodologies in the prior art which reduce pressure on the reactant products following reaction to allow $H_2S$ to be separated along with hydrogen gas, remove hydrogen sulfide from the hydrogen and then recompress the hydrogen in order to recycle back to the high pressure reactor. The need for this approach is to prevent an increase in HDS residual sulfur levels associated with $H_2S$ accumulation in the recycle loop. However, this increase in residual sulfur levels is associated not with unreacted organic sulfur molecules but rather the formation of elemental sulfur molecules. The present invention, by acting contrary to the conventional wisdom in the art, obtains efficiencies and lowered sulfur levels previously unobtainable without extensive processing and cost. These systems and processes are particularly useful for desulfurization of high sulfur (e.g., ~3000 ppm) hydrocarbon fuels (e.g., JP-8).

Depending upon the needs and necessities of the user, a variety of materials may be utilized for performing the aforementioned method steps. For example, the hydrogen containing gasses utilized for reaction with the elemental sulfur may include any of a variety of materials including, but not limited to, e.g., reformate product gases (shifted or unshifted) produced using steam reforming, autothermal reforming or partial oxidation reaction; retentate gases representing the hydrogen lean stream from a hydrogen separation process including, e.g., a hydrogen permeable membrane; or any other type of hydrogen containing gas. Preferably such gasses have lowered concentrations of water to avoid water contamination of the fuel. In addition, the catalyst utilized to bind the elemental sulfur to the hydrogen to form $H_2S$ may be any of a variety of catalysts including catalysts used to conduct the HDS reaction including NiMo and CoMo catalysts which use a molybdenum disulfide active phase as well as HDS catalysts that use a tungsten disulfide active phase, as well as a ZnO catalyst. Such catalysts may be provided as a packed bed of catalyst pellets, as catalyst coatings on random or structured packings, or any other configuration sufficient to allow the designated reactions to take place. Optimal efficiency is provided by arranging the column in a countercurrent configuration with liquid containing the elemental sulfur flowing down and hydrogen containing gas flowing up through the column. In this arrangement the hydrogen containing gas provides the dual function of enabling reaction of elemental sulfur to form $H_2S$ and of stripping the $H_2S$ into the gas phase to yield a desulfurized liquid product.

In order to maintain appropriate efficiencies, the separation of hydrogen containing gases from a liquid hydrocarbon takes place at a pressure drop of less than 10 psi. This reduces the cost of compressing the hydrogen containing gas for recycle to the HDS reactor. In mobile applications the ability to allow elemental sulfur formation in the HDS reaction enables the use of a smaller split stream of reformate for the HDS reaction resulting in increased efficiency. In other applications, use of a low hydrogen-containing gas:hydrocarbon ratio enables faster processing due to higher residence time in the reactor for a given hydrocarbon feed rate.

In one embodiment of the invention, optimum results were achieved when an unshifted reformate gas was introduced to the liquid hydrocarbon in the feed at a ratio at or below 1 standard liter of reformate gas per cubic centimeter ($cm^3$) of the liquid hydrocarbon, preferably less than 0.02 standard liters of reformate gas per cubic centimeter ($cm^3$) of the liquid hydrocarbon.

The method of the present invention is particularly effective on fuels such as JP-8, or other fuels that contain high concentrations of organic sulfur compounds. The ability to tolerate formation of elemental sulfur in the HDS reaction with subsequent removal downstream under less severe conditions allows the liquid HDS liquid product to be condensed and separated from the hydrogen containing gas at near full HDS pressure while the recycle of hydrogen containing gases can be accomplished with a low power compressor operating at a pressure differential of less than 10 psi. HDS reaction conditions will be feed specific but conditions of 270 psig and 380° C. were found effective for HDS of JP8 fuel. In contrast, the reaction of elemental sulfur in the liquid can occur near ambient pressure and ~150° C. The elemental sulfur reaction can utilize lower hydrogen content gases to drive the reaction compared to the HDS reaction and if used in a recycle arrangement the $H_2S$ can be removed from the loop and the majority of the hydrogen in the loop recycled. If reformate gases are used as the hydrogen source, the $H_2S$ removal can be configured to also remove $CO_2$ to prevent buildup of $CO_2$ in the recycle loop.

In various configurations, alterations to the basic method can be had. In particular, for a mobile system in which a hydrogen recycle on the HDS reactor is not implemented, the hydrogen-containing gas may be routed first to the reactor where elemental sulfur is converted to $H_2S$ and then carry this $H_2S$ into the HDS reactor, eliminating the need for a second hydrogen containing gas. The contacting step in which the elemental sulfur is reacted may include sparging the hydrogen-containing gas through the liquid hydrocarbon while the liquid hydrocarbon is in contact with the catalyst. The contacting step may also be performed in a countercurrent stripping column that is packed with the catalyst in a pelletized form so as to be in contact with the liquid hydrocarbon introduced to the column, wherein the liquid hydrocarbon flows down and the hydrogen-containing gas flows up. The countercurrent stripping column may be loaded with a packing (random or structured) coated with the catalyst such that the liquid hydrocarbon is in contact with the catalyst when introduced to the column. The reaction of elemental sulfur compounds in the hydrocarbon preferably occurs at a temperature between 50° C. and 150° C., a pressure between about 1 atmospheres (atm) absolute and 4 atmospheres (atm) absolute, and for a time sufficient to convert the elemental sulfur to $H_2S$.

In one embodiment of the invention, a dehydrodesulfurization (HDS) treated reaction product is condensed to form a liquid, this liquid is then reacted in the presence of a dehydrodesulfurization (HDS) catalyst and a hydrogen containing gas such as reformate to convert elemental sulfur compounds in the liquid to $H_2S$. The reaction is preferably performed at temperatures below about 200° C., preferably in the range from about 50° C. to about 150° C., well below those employed in typical HDS reactors.

In one embodiment, (i.e., hydrogen-rich) reformate gas containing a preselected minimum partial pressure of hydrogen is delivered (e.g., bubbled) through the liquid phase reformate fuel at a preselected flow rate, reacting with the elemental sulfur compounds present in the HDS reformate to form $H_2S$ gas, leaving a low (e.g., sub-ppm) residual sulfur concentration in the condensed phase product. In other embodiments, the hydrogen-containing gas is a shift gas, or a retentate gas. In one embodiment, reformate fuel in the feed exiting the HDS reactor is also cooled to, e.g., ~150° C. However, any temperature that condenses the reformate fuel to a liquid can be used. Preferred temperatures are in the range from 50° C. to about 150° C.

Once the condensed reformate fuel is separated from the hydrogen-rich reformate gas, the hydrogen-rich reformate gas is then used to accomplish the subsequent removal of elemental sulfur compounds present in the initial reformate fuel product. In one embodiment, the condensed liquid reformate fuel is contacted with an HDS catalyst (e.g., NiMo), while being sparged with a supply of hydrogen-rich gas. In a preferred embodiment, the hydrogen-rich gas is reformate gas collected from the HDS reactor earlier in the treatment process. The sparging of the reformats gas at a preselected rate into the condensed liquid reformats fuel product, reacts in the presence of the catalyst to convert elemental sulfur compounds present in the fuel to $H_2S$ gas.

The purpose of the foregoing abstract is to enable the United States Patent and Trademark Office and the public generally, especially scientists, engineers, and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Various advantages and novel features of the present invention are described herein and will become further readily apparent to those skilled in this art from the following detailed description. In the preceding and following descriptions, the preferred embodiment of the invention is shown and described by way of illustration of the best mode contemplated for carrying out the invention. As will be realized, the invention is capable of modification in various respects without departing from the invention. Accordingly, the drawings and following descriptions of the embodiments of the present invention set forth hereafter should be seen as illustrative and not limiting in any way. Additional advantages and novel features of the present invention will be set forth as follows and will be readily apparent from the descriptions and demonstrations set forth herein. A more complete appreciation of the invention will be readily obtained by reference to the following description of the accompanying drawings in which like numerals in different figures represent the same structures or elements.

DETAILED DESCRIPTION

The following description includes the preferred modes of various embodiments of the present invention. It will be clear from this description of the invention that the invention is not limited to these illustrated embodiments but that the invention also includes a variety of modifications and embodiments thereto. Therefore the present description should be seen as illustrative and not limiting. While the invention is susceptible of various modifications and alternative constructions, it should be understood, that there is no intention to limit the invention to the specific form disclosed, but, on the contrary, the invention is to cover all modifications, alternative constructions, and equivalents falling within the spirit and scope of the invention as defined in the claims.

Figure 1:
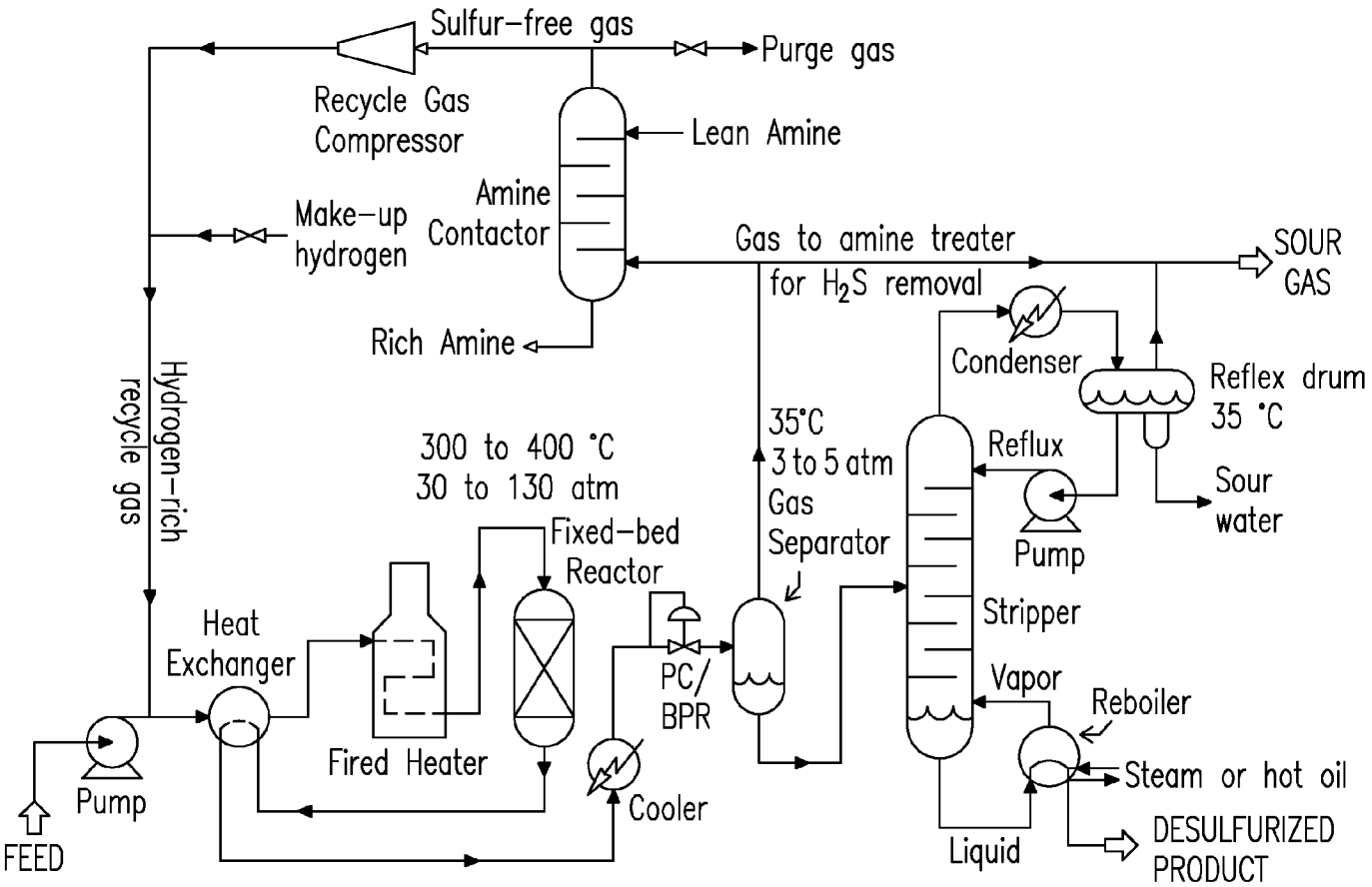
Fig. 1 (Prior Art)
FIG. 1 shows a conventional prior art hydrodesulfurization (HDS) flowsheet for removing organic sulfur-containing compounds from a hydrocarbon feedstock.

FIG. 1 shows a shows a typical prior art hydrodesulfurization (HDS) flowsheet for desulfurizing hydrocarbon fuels Application of HDS in an industrial setting is somewhat different than that used in gas phase reactors used for mobile applications. In general, in refinery processes, hydrotreating (a more general technology of which hydrodesulfurization is an example) is carried out by pressurizing a hydrocarbon (feed) that is heated in a heater (e.g., a fired heater) and introduced to an HDS reactor (e.g., a fixed bed reactor) together with hydrogen at a temperature between 300° C. to 500° C. Typical temperatures are between 300° C. and 345° C. (572° F. 653° F.). Hydrogen pressures are typically between 440 psi and 2060 psi (~300 kPa to 14186 kPa) (~30 atm and 140 atm), which converts sulfur in the hydrocarbon (feed) to $H_2S$. The HDS-treated (desulfurized) product is passed through a heat exchanger to remove excess heat (used to heat a subsequent cycle of raw feed) and subsequently cooled in a cooler which condenses the fuel and forms a vapor phase containing the $H_2S$ formed in the HDS reactor. Treated oil is separated from the excess hydrogen recycled through the reactor. In such configurations, a three phase system between liquid fuel and gaseous hydrogen exist at the surface of the solid catalyst. Elevated pressures help increase hydrogen solubility in the liquid, which improves mass transfer of gas to the surface of the catalyst. After leaving the HDS reactor, the reaction mixture is reduced in pressure which decreases solubility of $H_2S$ in the liquid, and partitions a greater portion of the $H_2S$ to the gas phase. The resulting gasses and liquid are then separated in a gas liquid separator. The liquid is sent to a distillation unit (stripper) that strips remaining $H_2S$ from the liquid. The remaining liquid is taken as the HDS desulfurized fuel product. $H_2S$ gas separated from the HDS-treated (desulfurized) liquid fuel product can be then sent to e.g., to a sour gas burner, or an amine contactor (absorber) or otherwise disposed of or reprocessed.

To maintain pressure in the system, the gas phase initially separated from the liquid following the reduction in pressure is compressed back to HDS pressure, and then combined with additional high pressure hydrogen. In conventional processing, $H_2S$ is presumed to act against the desulfurization of the product, therefore it is removed from the recycled gases prior to compression back to HDS pressure. The aim of this entire system is to attempt to keep all sulfur in the $H_2S$ phase and avoid the formation of any elemental sulfur. The present invention acts in direct contradiction to these prior art principles, recirculating $H_2S$ containing gas and driving the formation of elemental sulfur to be subsequently reacted with a hydrogen containing gas for removal.

The invention in various embodiments includes systems and methods for reduced-temperature removal of elemental sulfur compounds from condensed hydrocarbon reformate fuels (e.g., JP-8) obtained after HDS desulfurization of the starting feedstock (i.e., untreated) fuels. The term "HDS product" as used herein refers to an HDS treated reactor product obtained from an original sulfur-contaminated hydrocarbon fuel (e.g., JP-8). When desulfurizing high (>1500 ppm up to about 3000 ppm) sulfur fuels in a hydrodesulfurization (HDS) reformate process, elemental sulfur compounds can form in the HDS reaction vessel. That HDS treated fuels contain elemental sulfur compounds formed during the HDS process has not been previously reported or recognized in the prior art. However, chemiluminescent GC tests for sulfur show these elemental sulfur compounds to be absent in the starting feedstock fuels. However, when the HDS reformate product fuel is condensed, elemental sulfur compounds are dissolved in the fuel. At typical processing conditions, these elemental sulfur compounds can provide 100 ppm of sulfur contamination when processing high sulfur fuels (up to 3000 ppmw), which is sufficient to require a second desulfurization treatment of the hydrocarbon.

Figure 2:
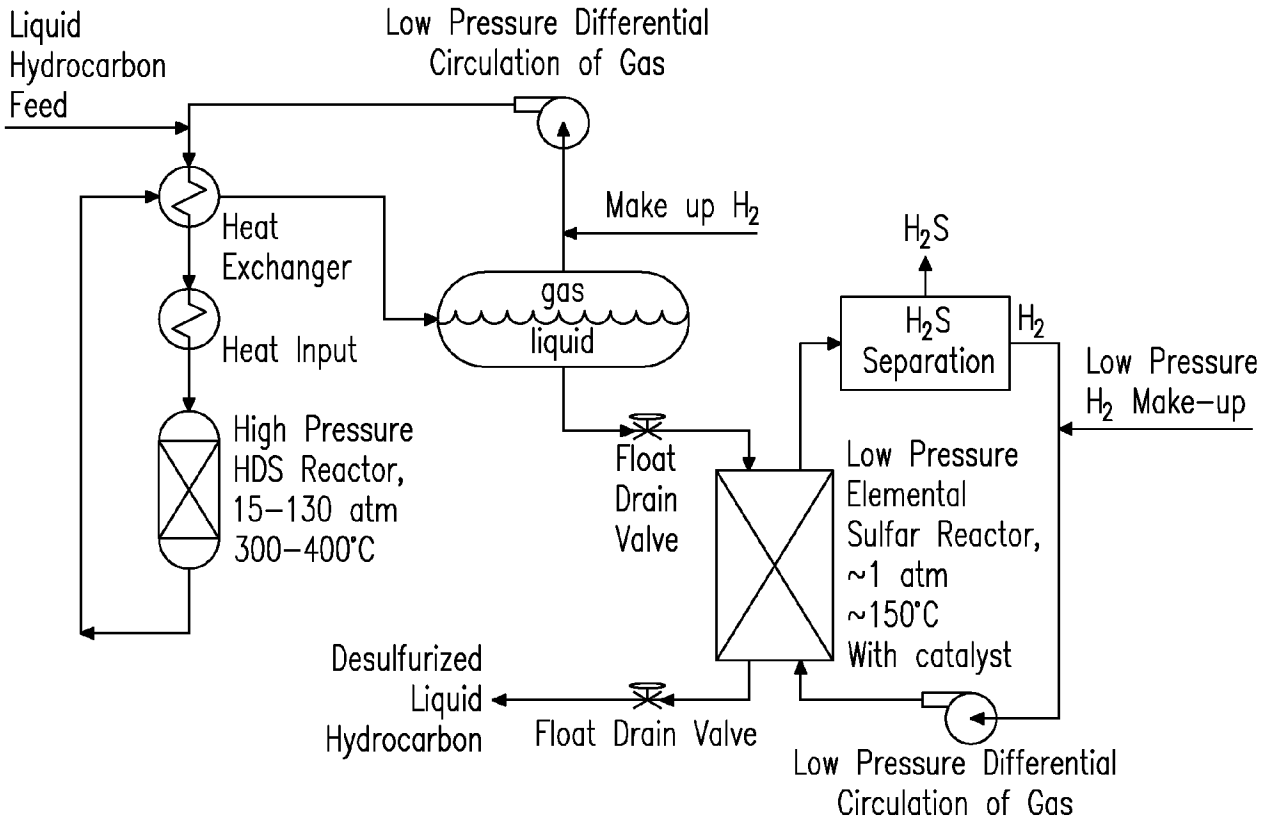
FIG. 2 shows a flowsheet for removing elemental sulfur compounds from a liquid hydrocarbon feed in which elemental sulfur is allowed to form in an HDS reaction and is then subsequently removed, according to one embodiment of the invention.

FIG. 2 shows a flowsheet according to a preferred embodiment of the invention for removing elemental sulfur compounds from the liquid product of an HDS reaction. This flowsheet does not require solid sorbents (e.g., ZnO) or other desulfurization agents to remove $H_2S$ formed during reaction of elemental sulfur compounds contained in the liquid HDS product. And, this flowsheet further shows the process whereby the hydrogen-containing gas is separated from the liquid HDS product and it recycled back to the HDS reaction without reducing the pressure or removing $H_2S$. In the figure, a liquid hydrocarbon feed containing a sulfur-containing hydrocarbon is introduced to an HDS reactor. In the embodiment shown in FIG. 2, the liquid feed is passed through heat exchanger and heater just prior to entry into HDS reactor, which serves to bring the temperature of the liquid feed to the appropriate reaction temperature, e.g., 300° C. to 400° C. and a high pressure between 15 atm and 130 atm. At this pressure and temperature, organic sulfur is converted to $H_2S$ gas. A quantity of elemental sulfur compounds are also formed and remains in the hydrocarbon. Following reaction, the HDS treated hydrocarbon liquid is passed through a heat exchanger where heat is exchanged with another feedstock entering HDS reactor, the treated liquid hydrocarbon then undergoes high-pressure vapor-liquid separation wherein $H_2S$ containing gasses are separated from the treated liquid. As the concentration of $H_2S$ in the recirculated gas increases, elemental sulfur is formed that dissolves in the fuel and is then withdrawn from the system along with the liquid product without requiring depressurization of the gas phase. Liquid hydrocarbon is removed from the bottom of the condenser or separator (e.g., via a float drain valve or other liquid only drain), and introduced to an elemental sulfur reactor containing a HDS conversion catalyst such as a NiMo, CoMo or other type of HDS catalyst sufficient to assist in the transformation of sulfur to $H_2S$ in the presence of a hydrogen-containing gas.

The hydrogen and $H_2S$ gas are recycled through the condenser, reheated and returned to the HDS reactor while the gases are maintained near the reaction pressure (e.g., 270 psig). This eliminates energy costs associated with compressing the hydrogen recycle stream, as a differential pressure of less than 10 psi is maintained. As shown in the figure, liquid reformate fuel is heated to temperature in a heat exchanger and heater just prior to entry into HDS reactor. Make-up of the hydrogen supply to the high pressure circulation loop need only be sufficient to satisfy the hydrogen consumed in saturating hydrocarbons and to replace hydrogen that leaves as dissolved hydrogen or dissolved $H_2S$ gas in the feed. The fraction of sulfur leaving in elemental form does not carry additional high pressure hydrogen from the system.

Low pressure hydrogen in contact with elemental sulfur containing liquid and the catalyst converts elemental sulfur back to $H_2S$ and this $H_2S$ can be carried with the hydrogen containing gas from the low pressure elemental sulfur reactor and then captured by an amine scrubber or other type of $H_2S$ capture device. The reaction of the elemental sulfur is preferably but not exclusively done via counter-current contact with hydrogen on a packing coated with an HDS catalyst, e.g., a nickel-molybdenum (NiMo) catalyst. Elemental sulfur compounds in the hydrocarbon liquid are converted to $H_2S$ gas by reaction with the catalyst at a low pressure of about 1 atm and a preferred temperature of about 150° C. on average, which is not limited. The ultimately desulfurized fuel product is removed, e.g., from the bottom of low-pressure elemental sulfur reactor. The sub-ppm sulfur level provided by this flowsheet means that the final fuel product can be steam-reformed, e.g., for use in fuel cell Auxiliary Power Units (APUs). This flowsheet is less energy intensive to remove $H_2S$ than that for distillation or steam stripping of the fuel.

In the particular embodiment shown in FIG. 2, the low pressure loop includes a Low pressure $H_2$ make up source of hydrogen containing gas that can be added to elemental sulfur reactor as needed via a pump such as a low pressure differential circulation pump to maintain hydrogen partial pressure in the reactor upon loss of $H_2S$ gas from the reactor. Alternatively, the hydrogen-containing gas in the low pressure loop can also be a shifted reformate gas instead of hydrogen gas. Thus, no limitations are intended. The reactor loses hydrogen as the elemental sulfur is converted to $H_2S$ and is removed from the system. Temperature and pressure of the low pressure elemental sulfur reactor can be adjusted as required when dealing with, e.g., a light hydrocarbon fractions that boil, e.g., at 1 atm and a temperature of <150° C. For example, if the hydrocarbon boils at 1 atm and a temperature of <150° C., either the reaction temperature will need to be lowered or the pressure increased to avoid excessive volatilization of the fuel in the elemental sulfur reactor. Alternatively, if elemental sulfur compounds are less volatile than, e.g., a light fraction present in the hydrocarbon mixture, an optional rectification column (not shown) can be inserted into the flowsheet to separate volatile hydrocarbons overhead while heavier hydrocarbons and elemental sulfur exiting the bottom of the column can be reacted to eliminate elemental sulfur compounds. $H_2S$ gas formed upon conversion of elemental sulfur compounds in the low pressure elemental sulfur reactor is separated from the hydrogen containing gas by processes including, but not limited to, e.g., amine scrubbing via amine sorbents, reaction with aqueous sodium hydroxide (NaOH) or calcium hydroxide [$Ca(OH)_2$], or other sour gas recovery systems. Some removal processes for $H_2S$ may also be effective for removal of $CO_2$ (if using reformate gases instead of pure hydrogen), which prevents buildup of $CO_2$ in the low pressure loop. A purge that prevents buildup of methane may also be needed in the low pressure loop.

Figure 3:
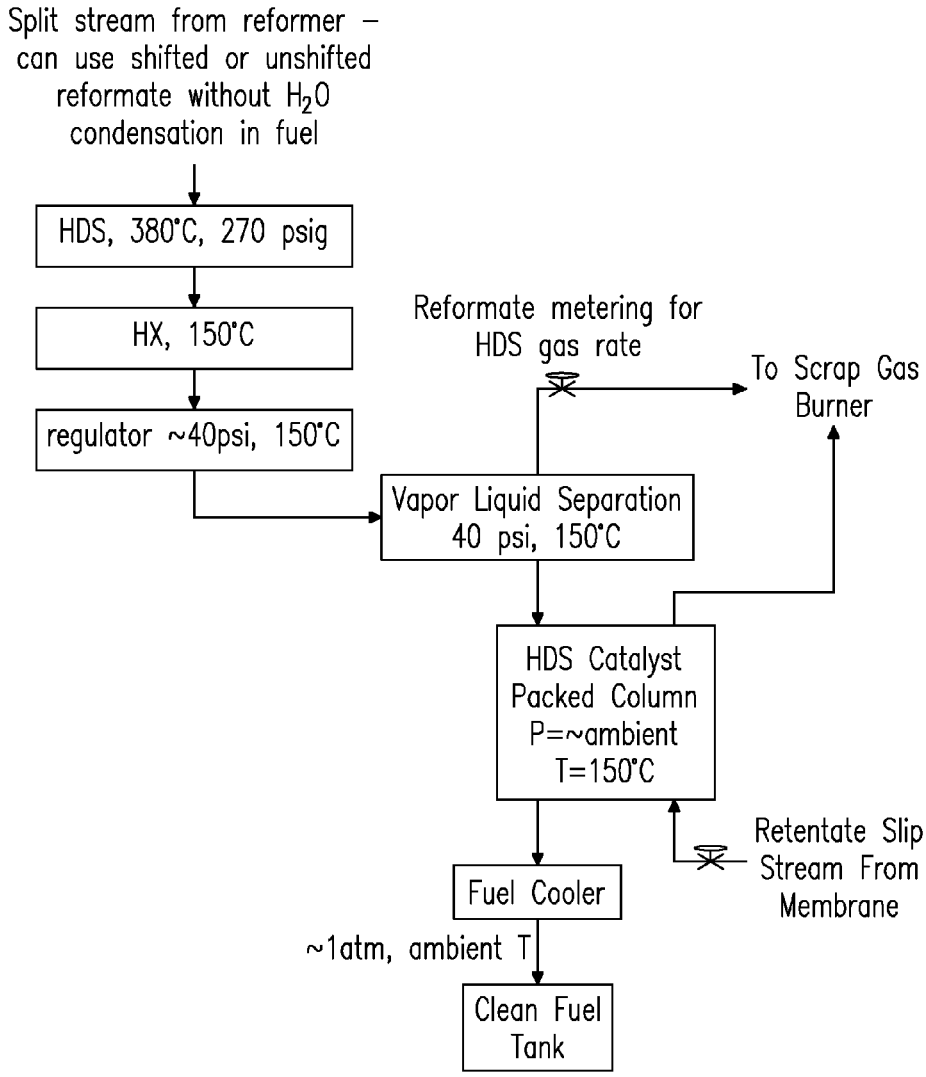
FIG. 3 shows a flowsheet for in which elemental sulfur formed in a reformate HDS reaction is removed in a configuration suitable for mobile applications, in which all $H_2S$ formed is routed to a burner according to another embodiment of the invention.

FIG. 3 shows an alternate flowsheet for removing elemental sulfur compounds from hydrocarbon feedstocks that provides low-sulfur fuels suitable for mobile applications including, e.g., fuel cells and other mobile devices. This flowsheet eliminates need for a solid desulfurization sorbent (e.g., ZnO) to remove $H_2S$ gas from the liquid fuel during conversion of elemental sulfur. In this embodiment, hydrogen-containing gas introduced to the HDS reactor can be a shifted reformate gas including steam, or an unshifted reformate from which most steam has been condensed. The reformate may be obtained as a split stream from the output of a steam reformer operating on the desulfurized fuel being produced. In FIG. 3, such a split stream is introduced into the system where an HDS treatment (e.g., at 380° C. and 270 psig) converts organic sulfur to $H_2S$ gas and produces elemental sulfur compounds in the hydrocarbon. A heat exchanger then cools the fuel to about 150° C., a regulator drops pressure to ~40 psig.

The fuel is then passed to vapor liquid separation stage where the fuel mixture now having a lower temperature and pressure (e.g., ~150° C. and a pressure of 40 psi) can be separated into a gas and a liquid phase. In such an arrangement, water vapor leaves in the gas phase and is not retained in the liquid fuel. Hence, condensation of reformate water becomes optional, or can be omitted as a step in the flowsheet while still avoiding a need for fuel/water separation following condensation. After separation, the liquid fuel is passed through a low pressure reactor where the elemental sulfur is reacted with a hydrogen containing gas in the presence of an HDS catalyst at a temperature of about 150° C. $H_2S$ is removed from the reactor in the gaseous phase and the liquid fuel is cooled and sent to a clean fuel tank. In a system using a palladium membrane to purify hydrogen for a fuel cell, the membrane retentate stream containing residual hydrogen may provide hydrogen for reaction with elemental sulfur to produce $H_2S$ and strip the $H_2S$ from solution. The $H_2S$ containing gases from the vapor-liquid separation and the reaction of elemental sulfur are routed to a combustor to recover fuel value. In embodiments such as mobile systems where $H_2S$ containing gas is combusted, temperatures downstream of the burner are maintained above the sulfuric acid dew point, typically 125° C. to 200° C., to avoid corrosion.

HDS systems and flowsheets according to these embodiments provide various routes for sulfur removal. Some of these eliminate the need for solid sorbents such as ZnO to remove $H_2S$ gas. Tests performed in conjunction with the invention have shown removal of elemental sulfur compounds from previously HDS desulfurized fuels to sub-ppm concentration levels suitable for various domestic and military uses. In other embodiments, retentate gas from a hydrogen permeating membrane can be used as an alternative to reformate gas. Hydrogen content of retentate gases is lower than for reformate gases, but is usually sufficient for use as a hydrogen-containing gas for reaction with elemental sulfur in the various flowsheets presented herein.

Figure 4:
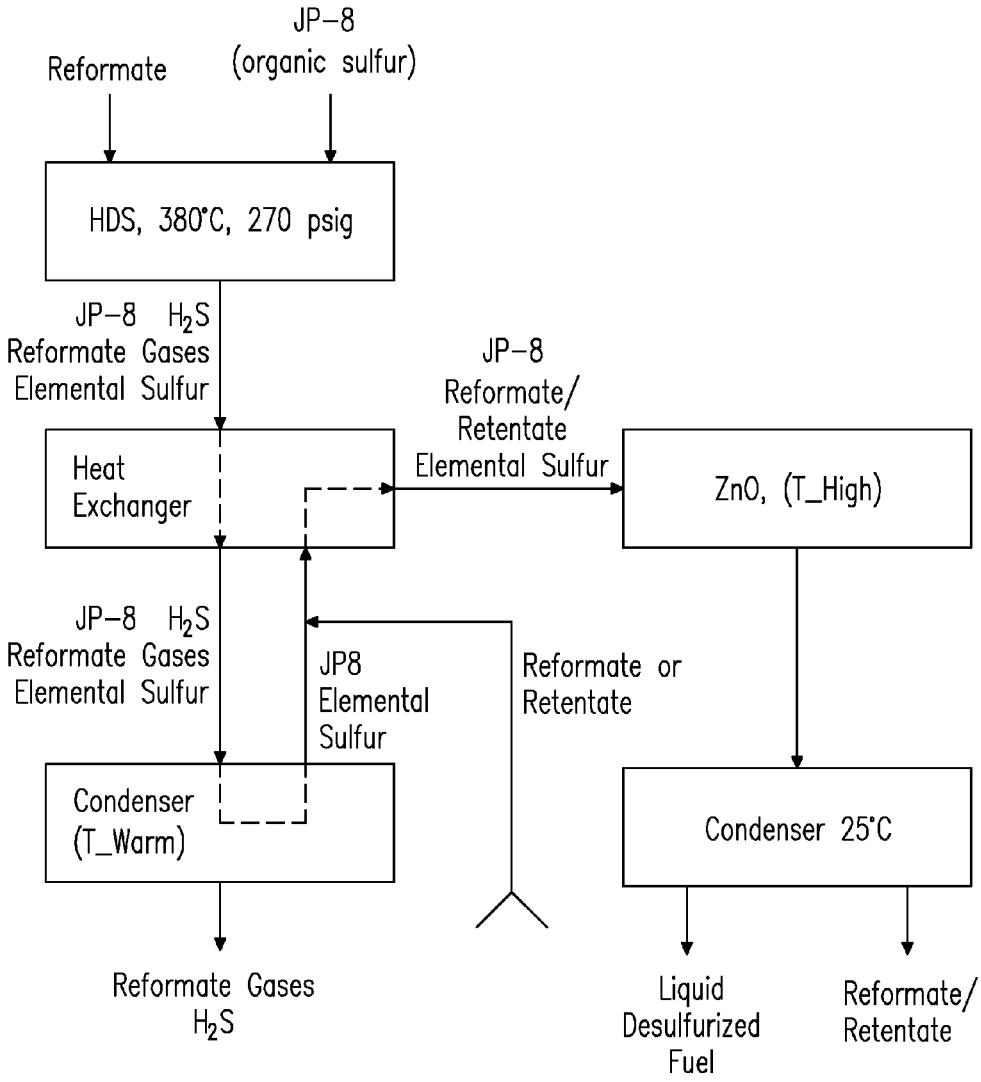
FIG. 4 shows a flowsheet that employs a second hydrogen-containing stream to react over a catalyst for removing elemental sulfur from the product of an HDS reformate reaction, according to another embodiment of the invention.

FIG. 4 shows another embodiment of the present invention configured for removing elemental sulfur from the product of a reformate HDS reaction. This flowsheet employs ZnO to catalyze the reaction between elemental sulfur and hydrogen to form $H_2S$ and then sequester the $H_2S$ via reaction with the ZnO to form ZnS. As shown in FIG. 4, reaction products from a HDS reactor containing $H_2S$ gas and elemental sulfur compounds is cooled in a recuperator, condensed, and vapor and liquid are separated. The liquid portion, containing elemental sulfur compounds, is then combined with a hydrogen containing gas, reheated in the recuperator and passed over a bed of ZnO. Elemental sulfur compounds in the HDS treated fuel are converted to $H_2S$ gas and then react with ZnO and are immobilized in the bed as ZnS. The hydrocarbon (now depleted of elemental sulfur compounds) exiting the ZnO absorbent/catalyst bed is subsequently condensed to a liquid in a second condenser having a much lower temperature (about 25° C.). Desulfurized liquid is recovered, e.g., from the bottom of condenser while low pressure, desulfurized hydrogen containing gas exits the condenser and may be utilized for fuel value without restrictions related to avoiding sulfuric acid corrosion. The resulting liquid has a sulfur content below a preselected maximum (sub-ppm), which makes it suitable for use as a liquid fuel.

Figure 5:
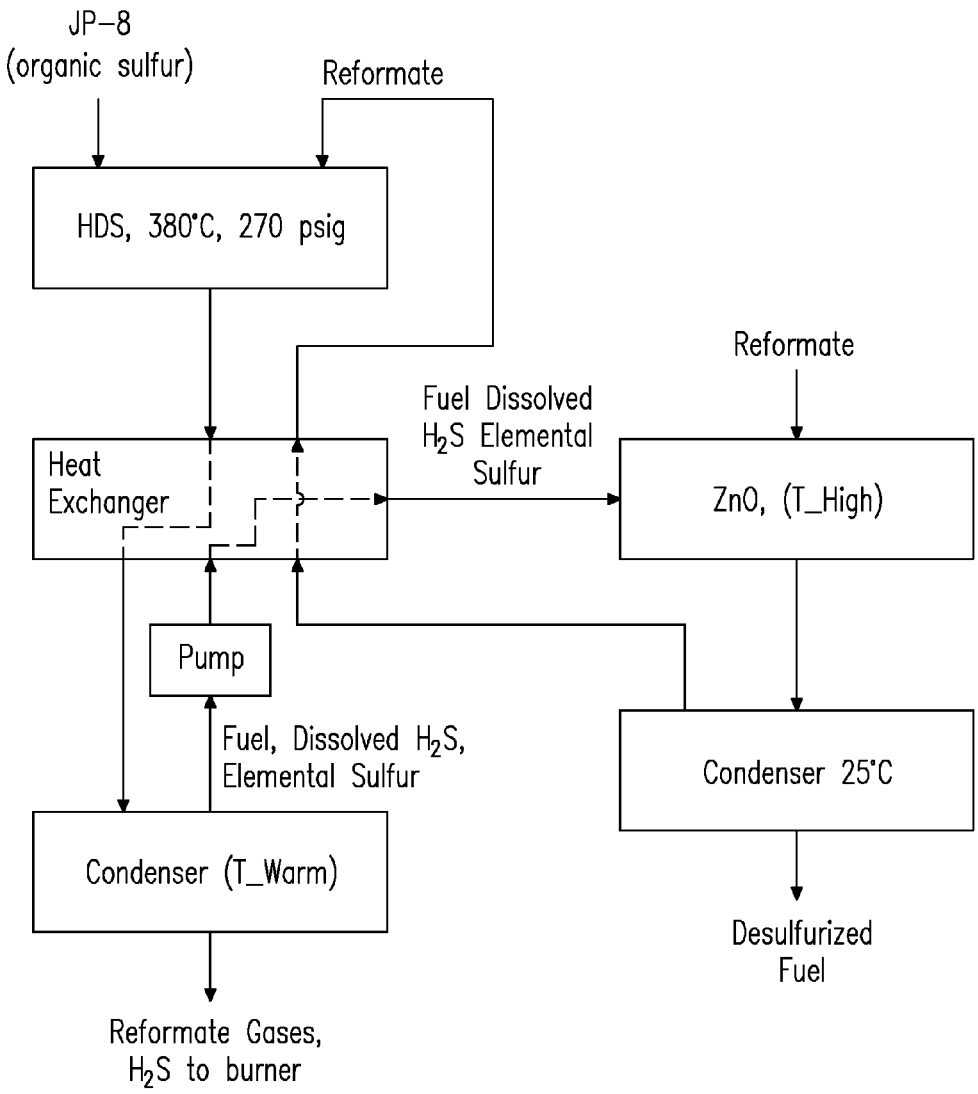
FIG. 5 shows another flowsheet that employs a catalyst for removing elemental sulfur from the product of a reformate HDS reaction, in which reformate used to react elemental sulfur is subsequently used in the HDS reaction, according to another embodiment of the invention.

FIG. 5 shows an alternate flowsheet for removing elemental sulfur compounds from the product of an HDS reaction. In this embodiment a JP-8 fuel is shown as an exemplary initial hydrocarbon feedstock introduced to the HDS reactor. (Exemplary operating conditions for the HDS reactor include a temperature of 380° C. and a pressure of 270 psig, however these parameters are provided as examples only and are not intended to be limiting). This flowsheet includes: 1) the removal of the majority of the sulfur as $H_2S$ gas in the gas stream exiting the condenser downstream from the HDS reactor ($H_2S$ gas being formed from conversion of organic sulfur in the HDS reaction), and 2) the removal of $H_2S$ dissolved in the liquid and resulting from conversion of elemental sulfur through reaction over ZnO with the incoming reformats stream. In order for reformate to flow from the reaction over ZnO to the HDS reactor the ZnO bed must be operated at higher pressure than the HDS reaction and a pump is required to deliver liquid product from the HDS reaction up to the pressure of the ZnO reaction.

In this configuration a hydrogen-containing reformate gas is used to react with elemental sulfur contained in a reformate HDS product. The reaction is performed over ZnO which catalyzes the reaction to form $H_2S$ and the reacts with $H_2S$ to immobilize the sulfur as ZnS. The reformate and desulfurized product then pass through a ~ambient temperature condenser and the reformate is separated from the liquid desulfurized fuel product. With residual $H_2S$ removed, the hydrogen-containing reformate gas is largely composed of hydrogen ($H_2$) and other residual gases including, e.g., $H_2O$ and $CO_2$. In this configuration the hydrogen-containing reformate gas is then routed to the HDS reactor at a suitable HDS reactor temperature by first passing through a heat exchanger. The reformate gas is then reacted with incoming fuel in the HDS reactor, condensed and separated into an $H_2S$ containing gas stream which is burned and a liquid fuel containing elemental sulfur which is preheated and then reacted over ZnO to remove elemental sulfur as described previously and then condensed in an ~ambient temperature condenser. The desulfurized fuel product exiting, e.g., from the bottom of condenser is suitable for use as a liquid fuel where sub-ppm sulfur levels are required.

Figure 6:
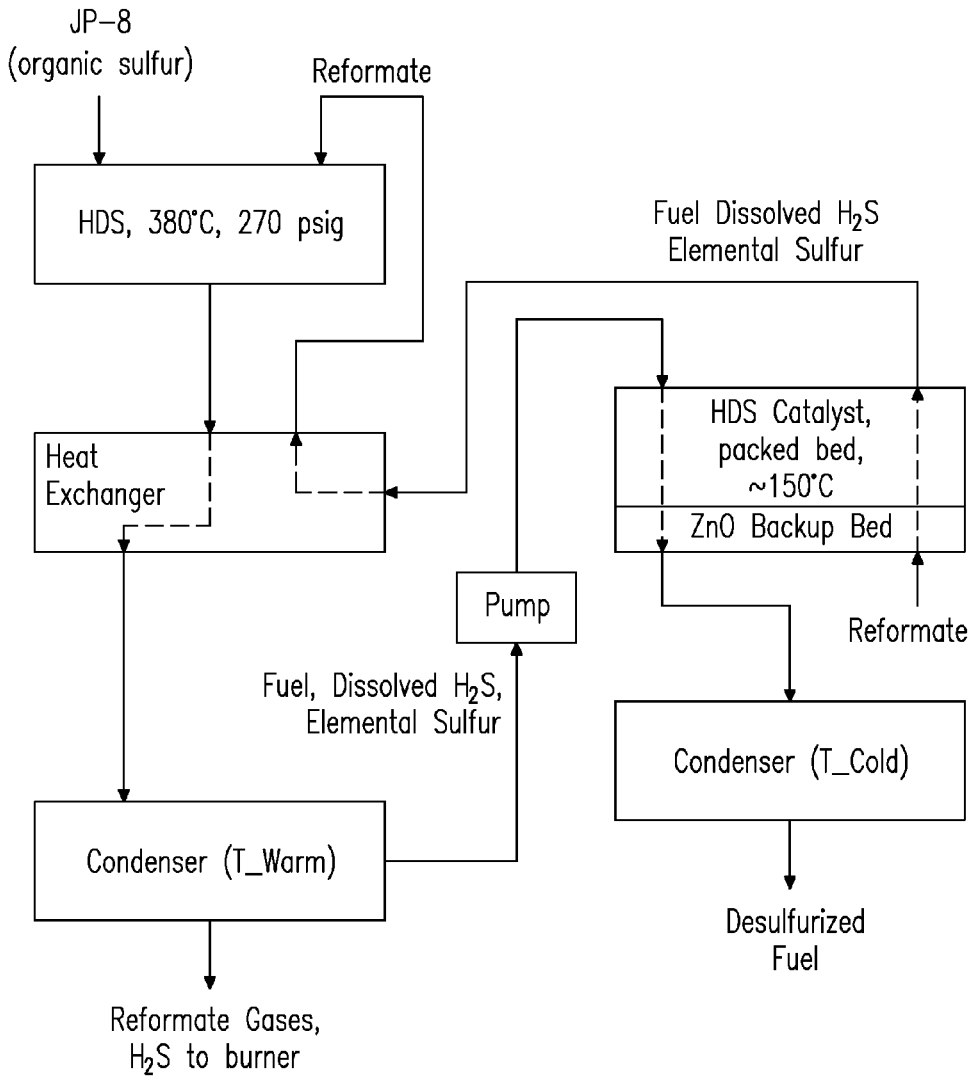
FIG. 6 shows a flowsheet that uses the same reformate stream in the reaction of elemental sulfur and in the HDS reaction and routes all $H_2S$ generated to a burner, according to another embodiment of the invention.

FIG. 6 is yet another flow sheet for removing elemental sulfur compounds formed in an HDS-treated product. In FIG. 6, a JP-8 fuel is shown as an exemplary initial hydrocarbon feedstock introduced to HDS reactor, but is not limited thereto. Exemplary operating conditions for HDS reactor include a temperature of 380° C. and a pressure of 270 psig. As described previously in FIG. 5, this flowsheet includes: 1) the removal of the majority of the sulfur as $H_2S$ gas in the gas stream exiting the condenser downstream from the HDS reactor ($H_2S$ gas being formed from conversion of organic sulfur in the HDS reaction), and 2) the removal of $H_2S$ dissolved in the liquid and resulting from conversion of elemental sulfur through reaction with the incoming reformate stream. However, unlike FIG. 5, the reaction of elemental sulfur with hydrogen is performed over an HDS catalyst with reformate and liquid fuel arranged in counter-current flow. In this configuration the $H_2S$ that was dissolved in the liquid or was formed through reaction of elemental sulfur with hydrogen is carried with the reformate stream and fed to the HDS reaction. This change eliminates the need for ZnO, except as a backup to guard against process upset conditions. As was the case in FIG. 5, in order for reformate to flow from the reaction eliminating elemental sulfur to the HDS reactor the elemental sulfur reaction must be operated at higher pressure than the HDS reaction and a pump is required to deliver liquid product from the condenser downstream of the HDS reaction up to the pressure of the elemental sulfur reaction.

Embodiments of the invention described herein have the advantage that the majority of the $H_2S$ formed in the HDS reactor is removed prior to contact with solid desulfurization sorbents that remove elemental sulfur. These processes increase the lifetime of the ZnO sorbent used to remove residual $H_2S$. When processing high sulfur feed containing 3000 ppm sulfur, 100 ppm of elemental sulfur may remain in the fuel following the HDS reaction step. This represents a 97% reduction in the sulfur that must be adsorbed by the sorbent. Other advantages include: 1) Savings in $H_2$ compression costs for the HDS reactor due to the elimination of the requirement to drop the mixture pressure to release $H_2S$; 2) Additional savings on $H_2$ compression costs due to the fraction of sulfur leaving the high pressure section as elemental sulfur rather than $H_2S$; 3) Relaxation of $H_2$:liquid feed ratios to the HDS reactor since formation of elemental sulfur compounds do not degrade performance because the present invention provides a way to remove the elemental sulfur from the system. 4) Ability to desulfurize very high sulfur-containing (>3000 ppm) streams to very low sulfur levels (sub-ppm) in a single HDS reaction step since the performance in a single stage is not limited by $H_2S$ buildup and subsequent formation of elemental sulfur compounds; 5) Ability to directly use reformate or low content hydrogen streams at a low pressure of about 1 atm to form the $H_2S$ rather than pure hydrogen at high pressure; and 6) a potential reduction in energy usage is achieved when $H_2S$ is removed as part of the elemental sulfur reaction via stripping by recirculated $H_2$, making a subsequent steam stripping or distillation of the desulfurized fuel unnecessary.

The following example provides a further understanding of the invention in one or more aspects.

100 mL of an HDS-treated JP-8 fuel initially containing a high concentration of sulfur (~3000 ppm) prior to HDS treatment at a pressure of 250 psig and a temperature of 360° C. was added to a sealed round bottom flask. The reformate fuel contained ~68 ppm elemental sulfur as determined from elemental sulfur peaks (peak areas reported in TABLE 1). Fuel in the flask was mechanically stirred. Reformats gas was sparged into the reformate fuel in the flask at a rate of 100 cc per minute (ccm). An initial sample (Sample 1) was collected ~19 minutes before catalyst addition (labeled "−15 minutes" in TABLE 1). Fuel in the flask was heated to a temperature of 150° C. and maintained. 10 g of HDS catalyst taken from the first of three reaction cylinders of an HDS test reactor which had been operated for ~300 hrs was added to the flask. The catalyst was not size-reduced prior to addition to the vessel.

Sample 2 was taken within ~30 seconds of catalyst addition. Sample 3 was taken 10 minutes after addition of the catalyst. Sample 4 was taken 30 minutes after addition of the catalyst. Results show treatment to remove elemental sulfur compounds from the reformate fuel liquid to be very effective. Test data also shows the reaction to be very rapid, with nearly complete removal of elemental sulfur occurring within the first 30 seconds of contact with the catalyst. One elemental sulfur compound identified by combined GC/MS analysis has been positively identified as cyclo-octo sulfur (i.e., $S_8$), a principal elemental sulfur compound. Behavior of other peaks in the chromatograms (also elemental sulfur compounds) correlate with those observed for $S_8$. Volatile compound peaks and other light gas peaks with retention times between 1.3 minutes and 1.6 minutes dissipate upon sparging with the reformate or other gases. $H_2S$ gas, initially absent, increases at 0 min and holds nearly steady at 10 minutes and then dissipates to very low levels. This observation correlates with the conversion of elemental sulfur compounds to $H_2S$ gas, which is subsequently stripped from solution, and correlates with the observed disappearance from the chromatograms.

TABLE 1

Results for removal of elemental sulfur from HDS-treated JP-8 fuel sparged with reformate gas in presence of an HDS catalyst at 150° C.

| Vial # | PDLE # | ~Time (min) | Peak-1 Area * | % Removed | Peak-2 Area ** | % Removed | Peak-3 Area *** | % Removed | Peak Area (Total) | % Removed |
|---|---|---|---|---|---|---|---|---|---|---|
| 1 | 1 | −15 | 19813 | −15.1 | 6970 | 13.0 | 41915 | −16.3 | 68698 | −12.2 |
| 2 | 2 | 0 | 8435 | 51.0 | 3448 | 57.0 | 15765 | 56.2 | 27648 | 54.9 |
| 3 | 3 | 10 | 0 | 100 | 0 | 100 | 74 | 99.8 | 74 | 99.9 |
| 4 | 4 | 30 | 0 | 100 | 0 | 100 | 0 | 100 | 0 | 100 |
| 5 | 5 | 60 | 0 | 100 | 0 | 100 | 0 | 100 | 0 | 100 |

Note:
negative removal on vial 1 indicates the elemental sulfur level was analyzed as being higher than an earlier analysis.
* Retention Time (RT) = 14.1 minutes.
** Retention Time (RT) = 17.3 minutes.
*** Retention Time (RT) = 19.9 minutes.

In another test, very low reformate:fuel ratios on a 10 $kW_e$ scale were tested for efficacy in view of the methodology described. In these tests, the ratio of reformate gas to liquid fuel feed in HDS reactor (in reaction step 1 for conversion of organic sulfur) was between about 1 standard liter of gas per cubic centimeter ($cm^3$) of the liquid hydrocarbon and about 0.02 standard liters of gas per $cm^3$ of the liquid hydrocarbon. Feed rates were: 7 (slpm): 60 (ccm) and 0.33 (slpm): 15 (ccm), respectively. The HDS reactor was followed immediately by a ZnO bed which facilitated the conversion of elemental sulfur to $H_2S$ and the reaction of $H_2S$ to form ZnS. Resulting sulfur levels in the liquid fuels for these tests were <0.1 ppm. Even lower gas:liquid ratios can be expected by optimization of the system parameters.

While preferred embodiments of the present invention have been shown and described, it will be apparent to those of ordinary skill in the art that many changes and modifications may be made without departing from the invention in its true scope and broader aspects. The appended claims are therefore intended to cover all such changes and modifications as fall within the spirit and scope of the invention.

What is claimed is:

1. A method for desulfurizing a hydrocarbon, the method comprising:

reacting organic sulfur compounds in the hydrocarbon with a first hydrogen-containing gas in the presence of a first catalyst to form $H_2S$ gas and to convert organic sulfur remaining in the hydrocarbon substantially into the form of elemental sulfur compounds;

separating a first $H_2S$-containing gas from the hydrocarbon containing the elemental sulfur compounds;

reacting the elemental sulfur compounds in the hydrocarbon with a second hydrogen-containing gas in the presence of a second catalyst to convert the elemental sulfur compounds in the hydrocarbon to $H_2S$ gas; and separating a second $H_2S$-containing gas formed from conversion of the elemental sulfur compounds from the hydrocarbon to obtain a desulfurized hydrocarbon.

2. The method of claim 1, wherein the first hydrogen-containing gas is a reformate product gas obtained from a steam reformer, an autothermal reformer, or a partial oxidation reactor.

3. The method of claim 2, wherein the second hydrogen-containing gas is a reformate product gas obtained from a steam reformer, an autothermal reformer, or a partial oxidation reactor.

4. The method of claim 2, wherein the second hydrogen-containing gas is a retentate gas obtained from a hydrogen permeable membrane separation.

5. The method of claim 1, wherein separating the first $H_2S$-containing gas from the hydrocarbon, reacting elemental sulfur compounds in the hydrocarbon to convert the elemental sulfur compounds to $H_2S$ gas and separating the second $H_2S$-containing gas, or combinations thereof to obtain the desulfurized hydrocarbon are performed over a solid $H_2S$ sorbent.

6. The method of claim 5, wherein the solid $H_2S$ sorbent contains ZnO.

7. The method of claim 1, wherein the first hydrogen-containing gas is a reformate gas obtained from a steam reformer which has not undergone water gas shift reaction at temperatures below the reformer exit temperature and from which water has been condensed.

8. The method of claim 7, wherein the first hydrogen-containing reformate gas is introduced to the hydrocarbon at a rate at or below 1 standard liter of reformate gas per cubic centimeter ($cm^3$) of the hydrocarbon, with the hydrocarbon volume evaluated in the liquid state.

9. The method of claim 7, wherein the first hydrogen-containing reformate gas is introduced to the hydrocarbon at a rate at or below 0.02 standard liters of reformate gas per cubic centimeter ($cm^3$) of the hydrocarbon.

10. The method of claim 7, wherein the hydrocarbon that contains organic sulfur compounds is a JP-8 fuel and the reaction with the first hydrogen-containing reformate gas is performed at a pressure of about 270 psig and a temperature of about 380° C.

11. The method of claim 1, wherein separating the first $H_2S$-containing gas from the hydrocarbon containing the elemental sulfur compounds includes:

condensing the hydrocarbon containing the elemental sulfur compounds at a pressure reduced less than 10 psi relative to the reaction pressure used for conversion of organic sulfur to form a liquid;

separating the liquid hydrocarbon containing elemental sulfur compounds from the first $H_2S$-containing gas comprising the remaining first hydrogen-containing gas and the majority of the $H_2S$ gas; and recycling a selected fraction of the first $H_2S$-containing gas back to the organic sulfur conversion reaction without removing the $H_2S$ gas from the first hydrogen-containing gas.

12. The method of claim 11, wherein:

reacting the elemental sulfur compounds in the hydrocarbon occurs at a pressure and temperature sufficient to form $H_2S$ gas and wherein the second catalyst used in reacting the elemental sulfur compounds in the hydrocarbon is a ZnO catalyst; and wherein separating the second $H_2S$-containing gas formed from conversion of the elemental sulfur compounds comprises reacting the formed $H_2S$ gas with the ZnO catalyst to form ZnS, yielding the desulfurized hydrocarbon with a concentration of sulfur below a preselected maximum and the second $H_2S$-containing gas with a reduced concentration of $H_2S$.

13. The method of claim 12, wherein the second $H_2S$-containing gas formed in the reaction with elemental sulfur compounds over the ZnO catalyst and separated from the desulfurized hydrocarbon is used as the first hydrogen-containing gas in the organic sulfur conversion reaction.

14. The method of claim 1, wherein the first hydrogen-containing gas used in the organic sulfur conversion reaction includes a quantity of the second $H_2S$-containing gas obtained from conversion of the elemental sulfur compounds, wherein the first hydrogen-containing gas flows by pressure differential from the elemental sulfur reaction vessel through a heat exchanger and into the organic sulfur conversion reaction vessel, and wherein the hydrocarbon containing sulfur primarily in the form of elemental sulfur compounds from the organic sulfur conversion reaction is pumped up in pressure to react and remove the elemental sulfur compounds.

15. The method of claim 1, wherein the reaction with the hydrocarbon containing sulfur primarily in the form of elemental sulfur compounds includes sparging the second hydrogen-containing gas through the hydrocarbon while the hydrocarbon is in contact with the catalyst.

16. The method of claim 1, wherein the reaction with the hydrocarbon containing sulfur primarily in the form of elemental sulfur compounds is performed in a countercurrent stripping column that is packed with the second catalyst in a pelletized form so as to be in contact with the liquid hydrocarbon introduced to the column, wherein the hydrocarbon flows in a first direction and the second hydrogen-containing gas flows in a second direction.

17. The method of claim 16, wherein the countercurrent stripping column is loaded with a packing coated with the catalyst such that the hydrocarbon is in contact with the catalyst when introduced to the column.

18. The method of claim 17, wherein the packing is a structured packing or a random packing.

19. The method of claim 1, wherein the second hydrogen-containing gas is a reformate gas obtained from: a steam reformer, an autothermal reformer, or a partial oxidation reactor.

20. The method of claim 1, wherein the second hydrogen-containing gas is a hydrogen-depleted reformate obtained from a hydrogen-separation process selected from the group consisting of: pressure-swing adsorption processes, temperature-swing adsorption processes, hydrogen-permeating membrane processes, and combinations thereof.

21. The method of claim 1, wherein the second hydrogen-containing gas is a retentate gas obtained from a hydrogen permeable membrane separation.

22. The method of claim 1, wherein the reaction of elemental sulfur compounds in the hydrocarbon occurs at a temperature between 50° C. and 150° C., a pressure between about 1 atmospheres (atm) absolute and 4 atmospheres (atm) absolute, and for a time sufficient to convert the elemental sulfur to $H_2S$.

* * * * *